United States Patent [19]

Nishioka

[11] Patent Number: 4,778,335

[45] Date of Patent: Oct. 18, 1988

[54] TOTAL FLOW TURBINE STAGE

[75] Inventor: Ryozo Nishioka, Yokohama, Japan

[73] Assignee: Fuji Electric Co., Ltd., Japan

[21] Appl. No.: 45,700

[22] Filed: Apr. 29, 1987

Related U.S. Application Data

[63] Continuation of Ser. No. 765,712, Aug. 14, 1985, abandoned.

[30] Foreign Application Priority Data

Sep. 18, 1984 [JP] Japan ..... 59-195377

[51] Int. Cl.[4] ..... F01D 1/20

[52] U.S. Cl. ..... 415/81; 415/191; 415/199.5

[58] Field of Search ..... 415/181, 183, 185, 191, 415/193, 194, 202, 216, 199.5, 80, 81; 416/223 A, DIG. 2

[56] References Cited

U.S. PATENT DOCUMENTS

| | | | |
|---|---|---|---|
| 767,689 | 8/1904 | Hedlund | 415/194 |
| 1,042,147 | 10/1912 | Samuelson | 415/194 X |
| 1,749,528 | 3/1930 | De Freudenreich | 416/223 A X |
| 1,771,023 | 7/1930 | Allen | 416/223 A X |
| 2,378,372 | 6/1945 | Whittle | 415/183 X |
| 2,410,259 | 10/1946 | Birmann | 415/81 |
| 3,475,108 | 10/1969 | Zickuhr | 416/223 A X |
| 3,953,148 | 4/1976 | Seippel et al. | 415/194 X |

FOREIGN PATENT DOCUMENTS

| | | | |
|---|---|---|---|
| 563691 | 11/1932 | Fed. Rep. of Germany | 416/223 A |
| 1426847 | 10/1969 | Fed. Rep. of Germany | 415/199.5 |
| 9367 | of 1908 | United Kingdom | 415/199.5 |
| 9889 | of 1909 | United Kingdom | 415/199.5 |

OTHER PUBLICATIONS

The LLL Geothermal Energy Program—A Status Report on the Development of the Total-Flow Concept, A. L. Austin, A. W. Lundberg.

Performance of a Total-Flow Impulse Turbine for Geothemal Applications, W. J. Comfort III.

*Primary Examiner*—Robert E. Garrett

*Assistant Examiner*—Joseph M. Pitko

*Attorney, Agent, or Firm*—Brumbaugh, Graves, Donohue & Raymond

[57] ABSTRACT

A total flow turbine comprises a total flow nozzle and rotor vane train designed to allow a two-phase fluid comprising water and water vapor to pass through the rotor vane train with little deflection to minimize collision of the water with the rotor vane walls.

3 Claims, 3 Drawing Sheets

1. TOTAL FLOW NOZZLE
2. IMPULSE VANE $C_1$ VELOCITY AT NOZZLE OUTLET $W_1$ RELATIVE VELOCITY AT ROTOR VANE INLET u PERIPHERAL VELOCITY OF ROTOR VANE $W_{2S}$ RELATIVE VELOCITY AT ROTOR VANE OUTLET FOR STEAM $C_{2S}$ VELOCITY AT ROTOR VANE OUTLET FOR STEAM $W_{2W}$ RELATIVE VELOCITY AT ROTOR VANE OUTLET FOR WATER $C_{2W}$ VELOCITY AT ROTOR VANE OUTLET FOR WATER

TOTAL FLOW TURBINE STAGE

This application is a continuation of application Ser. No. 765,712 filed Aug. 14, 1985.

FIELD OF INVENTION

This invention relates to a total flow turbine capable of directly expanding a fluid, such as hot water or a mixture of hot water and water vapor, by a total flow nozzle and letting the fluid act on the rotor vane of a turbine to convert its energy into power.

BACKGROUND OF THE INVENTION

As a total flow turbine of this type, there have generally been used impulse turbines. However, no highly efficient impulse total flow turbine has been developed yet. The reason for this is that the hot water being expanded in the nozzle is reduced to a two-phase fluid and such fluid is not transferred with high efficiency while it passes through the impulsive vane.

When saturated hot water having a pressure of 5 atmospheres is expanded to reach the atmospheric pressure and expected to change with substantially constant entropy, 91% by weight of the resultant is composed of water, and so 91% of the velocity energy is retained by the water, whereas the water vapor accounts for 99.4% of the total volume. As a result, although passage in the rotor vane is normally designed in consderation of the flow of water vapor accounting for 99.4% of the volume, water drops are not capable of joining the flow of water vapor which is deflecting at a small radius of curvature in the rotor vane, since the density of water is 1,659 times greater than that of water vapor and the water drops collide directly with the side wall of the rotor vane and flow as a thin viscous layer thereon and then out of the rotor vane. There is subsequently produced a significant difference in velocity between the water vapor and water flowing out of the rotor vane and thus their velocity triangles at the outlet of the rotor vane become entirely different from each other. This relation is shown in FIG. 7.

In FIG. 7, the solid and dotted lines, respectively, show the flow of water vapor and that of water drops within the total flow nozzle 1 and the impulse vane 2.

In FIG. 7, $C_1$ denotes the velocity at the nozzle outlet, $C_{2W}$ and $C_{2S}$ the velocity at the rotor outlet of the water and steam, respectively, $W_1$ the relative velocity at the rotor vane inlet, $W_{2W}$ and $W_{2S}$ the relative velocity at the rotor vane outlet of the water and steam, respectively, and u is the peripheral velocity of the rotor vane.

A study of the total flow impulse turbine based on the above consideration when an optimum velocity ratio is selected for the impulse turbine revealed from trial calculation that the efficiency of water, accounting for 91% of the total weight, reached only 38%, about half of the 74% of the water vapor. The overall efficiency of the total flow turbine became as low as about 42%.

Since a velocity coefficient of greater than 90% has been attained by the total flow nozzle when its dimensions and shape are suitably selected, the present invention attempts to make available a highly efficient total flow turbine stage by skillfully utilizing the above art, improving the rotor vane train and solving the aforementioned problems characteristic of the impulse total flow turbine. Since the problems related to the impulse total flow turbine, as mentioned above, result from causing a two-phase fluid composed of water and water vapor to deflect from the optimum flow path in the rotor vane to a large extent, the present invention is intended to make possible highly efficient power conversion with the least loss by improving the flow passage within the rotor vanes largely to prevent the two-phase fluid flowing in the passage inside the rotor vanes from producing water drops which collide with the rotor vane profile.

SUMMARY OF THE INVENTION

In view of the foregoing, the present invention provides a total flow turbine stage comprising a total flow nozzle for expanding and accelerating hot water, or a mixture of hot water and water vapor, as fluid for driving the turbine, and a rotor vane train for receiving the driving fluid which has been accelerated by the nozzle and having a passage formed in such a manner as largely to prevent the driving fluid flowing through the passage from deflecting significantly therein, the cross section of the passage being cone-shaped to allow for the continuous expansion and acceleration of the fluid. The cross section of the rotor vane profile may be prepared in the form of a plane vane train and the fanwise cross section of the passage along the rotor vane may be formed by increasing the vane length. Moreover, by this expedient the degree of reaction may be as high as 70 to 90% and the velocity triangles at the outlet of the nozzle and the inlet of the rotor vane may preferably be almost nearly an equilateral triangle.

A total flow turbine constructed according to the present invention allows the two-phase fluid flowing through the passage along the rotor vane to have little deflection and so water drops are not caused to collide with the rotor vane walls, and this results in reduced loss in the total flow turbine stage and makes possible highly efficient power conversion.

DETAILED DESCRIPTION

Figure 1:
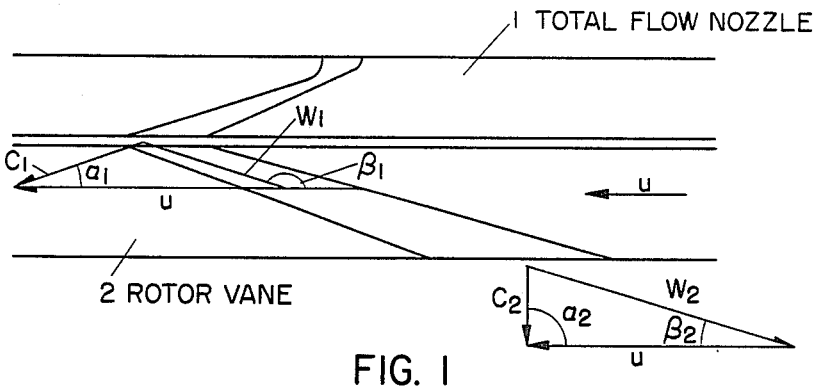
FIGS. 1 and 2 each shows a sectional view along the mean diameter of the nozzle and rotor vane of a turbine in accordance with the invention.
Figure 2:
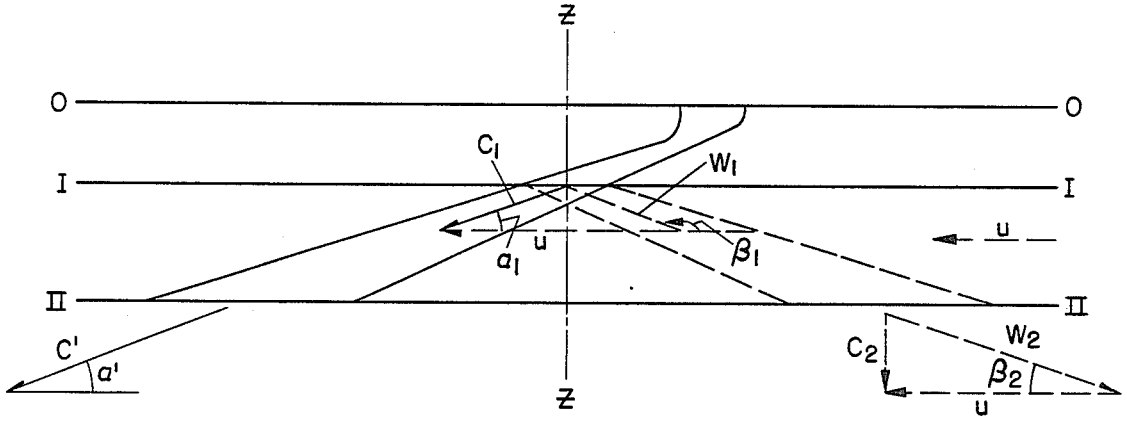

Referring now to FIGS. 1 and 2 showing an embodiment of a total flow turbine stage, the present invention will be described in detail. The total flow nozzle 1 is shown supplying fluid to the rotor vane 2. In a total flow nozzle hot water, shown by a solid line in FIG. 2, passing through the cone-like nozzle expands and flows out of the nozzle at a speed of C' and an angle of $\alpha'$. Assume that the nozzle is divided on the plane I—I in the axial direction (Z—Z) and the profile of the nozzle in the section between the planes I—I and II—II is rearranged with mirror symmetry as shown by the broken lines about the axis Z—Z to form a rotor vane profile, which is rotated at a peripheral velocity of u; if the peripheral velocity u is selectively set to satisfy the relations $C_1=W_1$, $\alpha_1=\pi-\beta_1$ between the speed $C_1$ at the outlet for the hot water, the relative speed $W_1$ at the inlet of the rotor vane to the outlet, angle $\alpha_1$ ($\alpha_1=\alpha'$) and the relative inlet angle $\beta_1$, that is, if we let the velocity triangle at the inlet of the rotor vane roughly become an equilateral triangle, the hot water will expand as though it were flowing through one total flow nozzle and out of the rotor vane at a speed of $W_2$ ($W_2=C'$), and an angle of $\beta_2(\beta_2=\pi-\beta_1=\alpha_1=\alpha')$. In this case, the deflection angle $\Delta\beta=\pi-(\beta_1+\beta_2)=0$. In other words, the hot water can attain both expansion and increased speed with minimized loss while flowing within the nozzle and the rotor vane as if it were flowing through a straight total flow nozzle.

Figure 3:
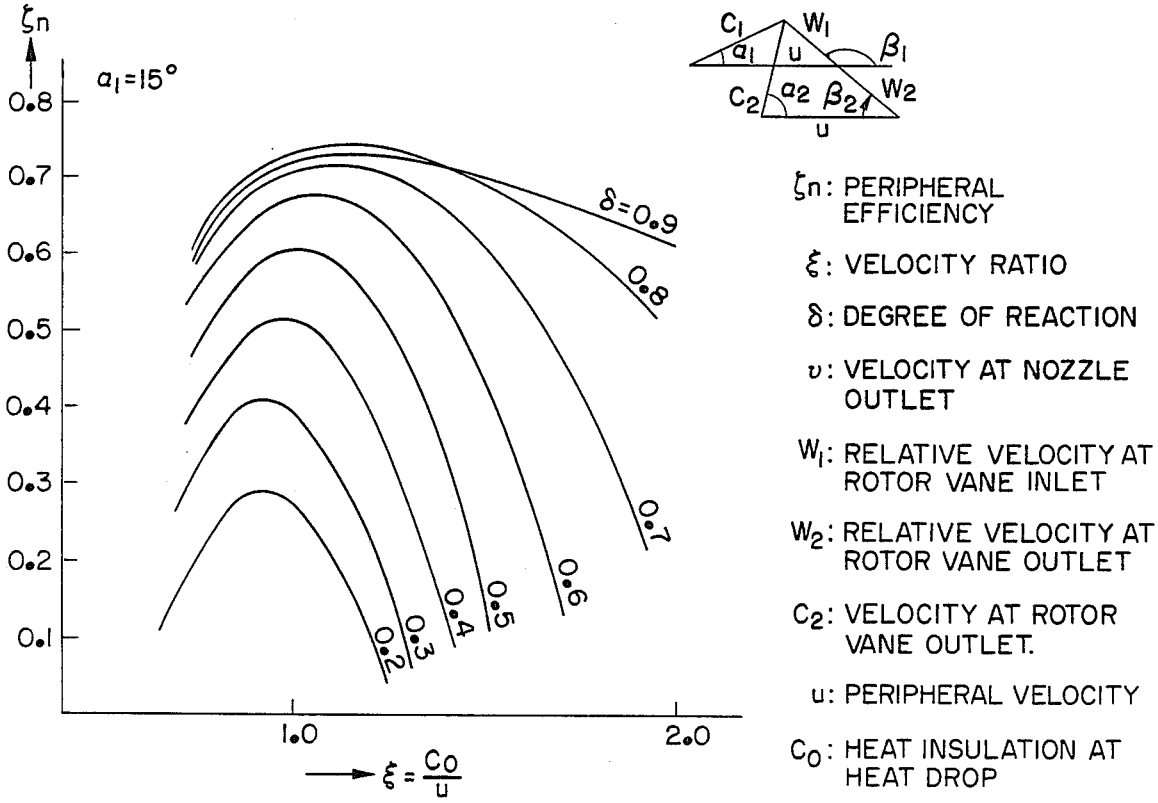
FIGS. 3 and 4 are graphs useful in the description of the invention.
Figure 4:
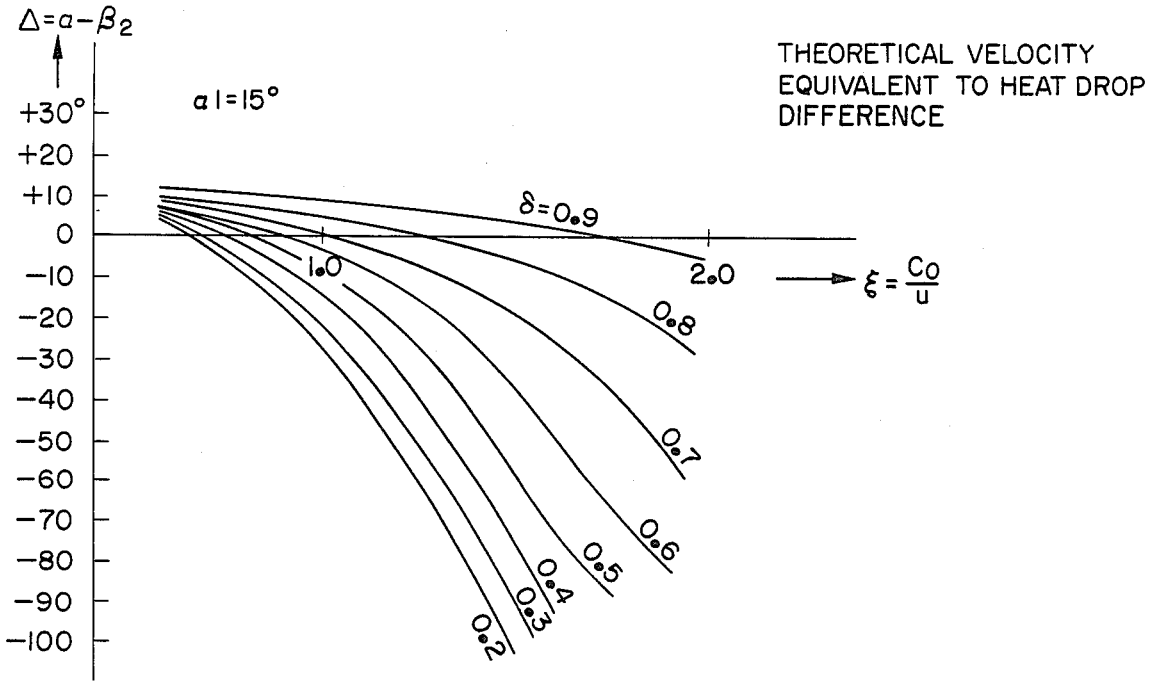

FIGS. 3 and 4 show the peripheral efficiency $\eta n$; the degree of reaction E, the speed ratio $\epsilon$ and the relation $\Delta=\alpha_1-\beta_2$ of the total flow turbine stage allowing no defection within the rotor vane (i.e., $\Delta\beta=\pi-(\beta_1+\beta_2)=0$).

In this example, it is assumed that $\delta_1=15$, the velocity coefficient $\phi$ (nozzle)$=\phi$ (rotor vane)$=0.9$. From FIG. 3, the maximum value of the peripheral efficiency is seen to be obtainable within the range of a degree of reaction as high as $0.7\sim0.9$ and the speed ratio $\xi$ ($=Co/u$) in the range from 1.0 to 1.5.

Moreover, the angle difference $\Delta=\alpha_1-\beta_2$ approaches zero. By this is meant that the velocity triangle at the inlet of the rotor vane roughly becomes an equilateral triangle.

Figure 5:
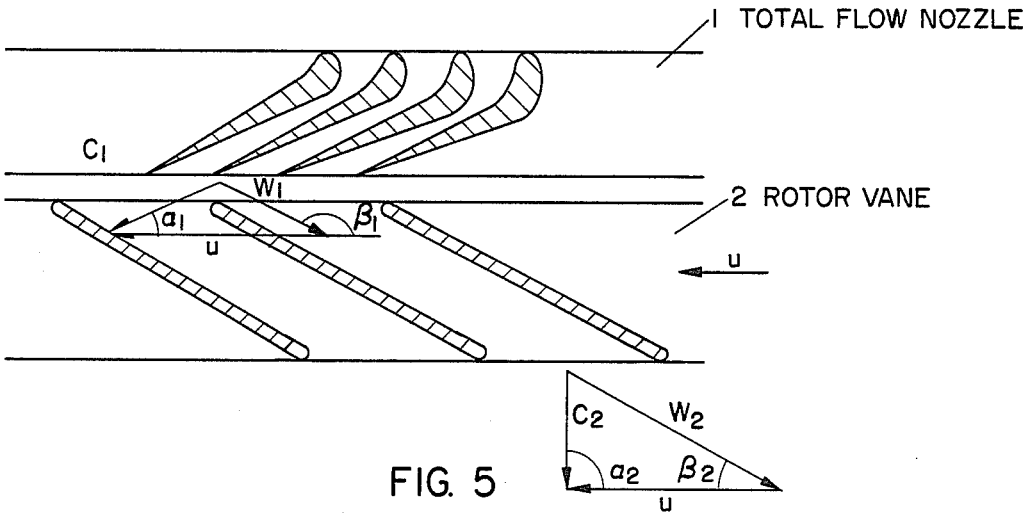
FIGS. 5 and 6 show cross sections of the profile of another embodiment of the invention on its mean diameter and on the axial direction, respectively.
Figure 6:
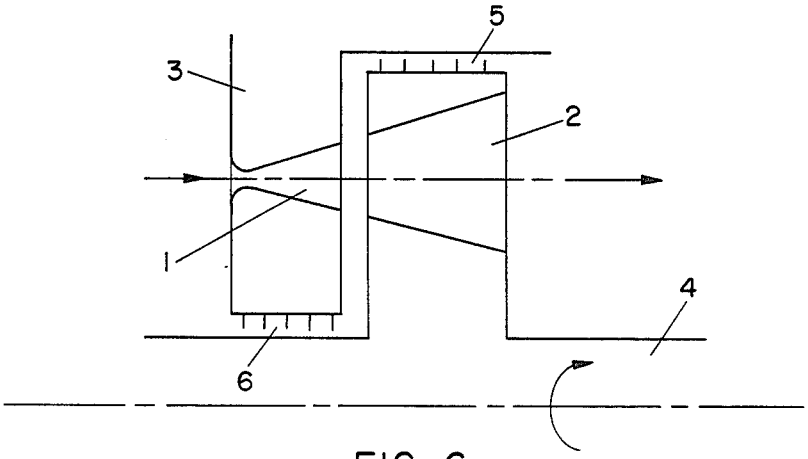
Figure 7:
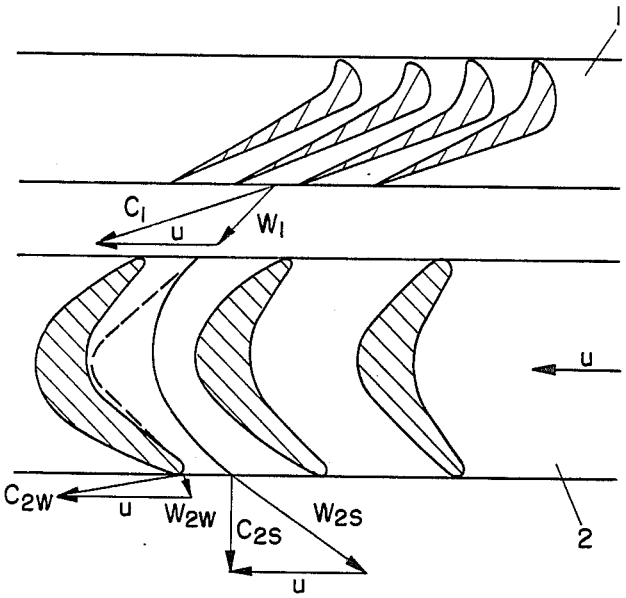
FIG. 7 PRIOR ART
FIG. 7 shows prior art.

FIGS. 5 and 6 show another embodiment of the total flow turbine according to the present invention. FIG. 5 illustrates the cross section of the profile on its mean diameter, whereas FIG. 6 indicates its cross section in the axial direction. FIGS. 5 and 6 illustrate a turbine comprising a total flow nozzle 1, a rotor vane 2, a nozzle holder 3, a rotor 4, and labyrinth seals 5, 6. In this example, a plane vane train is employed for the rotor vane profile to minimize the deflection of the flow in the rotor vane, wherein although hot water flows through the nozzle and the rotor vane as if it were to flow through one total flow nozzle and expand, the expansion of the area of the flow passage of the rotor vane is, as shown in FIG. 6, formed with an increase in height from the inlet to the outlet of the rotor vane. The velocity triangle at the nozzle outlet (rotor vane inlet) is defined as $\alpha_1=\pi-\beta_1=\beta_2$ according to the present invention and consequently $C_1=\omega_1$, thus permitting the formation of an equilateral triangle. As the turbine stage drop has a high degree of reaction, there occurs a pressure difference between the preceding and following stages and accordingly thrust force will act on the rotor in the axial direction. However, this problem can be solved through the conventional method including increasing the capacity of the thrust bearing, installing a balance piston and forming a binary counter flow.

As set forth above, although a description has been given by taking a two-phase fluid of water and water vapor as an example, the present invention is also applicable to a multistage structure where the stage drop difference is greater or to total flow turbines using Freon, ammonia or media other than water vapor.

The total flow turbine stage according to the present invention is formed so that it prevents the two-phase fluid flowing through the flow passage within the rotor vane from deflecting by providing the flow passage with a cone-shaped cross section, thereby enabling the contents to expand at continuously increased speed and preventing the two-phase fluid flowing in the flow passage from being curved and thus preventing water drops from colliding with the rotor vane profile and resulting in loss, thereby to ensure more efficient power conversion.

I claim:

1. A total flow reaction turbine stage, comprising: a total flow nozzle for accelerating a combined liquid and gaseous turbine driving fluid; and a rotor vane train for receiving the driving fluid accelerated by said nozzle, said rotor vane train having rotor vanes shaped and disposed to define a passage of increasing cross-sectional area through which said driving fluid flows and expands, wherein when said vane train is moving at a first peripheral velocity, said driving fluid flowing through the passage is prevented from being substantially deflected therein so that collision of droplets of the liquid with rotor vane walls is minimized.

2. A total flow turbine stage as claimed in claim 1, wherein the rotor vane train planar vanes and the height of the passage between adjacent vanes increases with distance between the inlet and outlet.

3. A total flow turbine stage as defined in claim 1 or 2, wherein a triangle formed by the velocity of the driving fluid at the nozzle outlet, the velocity of the driving fluid in the passage between adjacent vanes and the peripheral velocity of the rotor vanes is substantially an equilateral triangle.

* * * * *